United States Patent [19]

Zijlstra

[11] 4,249,611

[45] Feb. 10, 1981

[54] MARINE CONDUCTOR STRING PROVIDED WITH A CONNECTOR AND A CONNECTOR FOR USE IN SUCH A MARINE CONDUCTOR STRING

[75] Inventor: Kornelis N. Zijlstra, Cults, Scotland

[73] Assignee: Shell Oil Company, Houston, Tex.

[21] Appl. No.: 73,356

[22] Filed: Sep. 7, 1979

[30] Foreign Application Priority Data

Sep. 15, 1978 [GB] United Kingdom ..... 37040/78

[51] Int. Cl.[3] ..... E21B 17/01; E21B 17/08; E21B 34/16

[52] U.S. Cl. ..... 166/367; 166/334; 251/344

[58] Field of Search ..... 166/367, 316, 334, 333, 166/332, 362, 363, 241, 242, 75 R, 97; 251/343, 344, 347; 175/317

[56] References Cited

U.S. PATENT DOCUMENTS

| | | | |
|---|---|---|---|
| 1,601,676 | 9/1926 | Burright | 166/334 |
| 2,337,429 | 12/1943 | Tomlinson | 166/333 X |
| 2,531,943 | 11/1950 | Lee | 251/343 |
| 2,906,493 | 9/1959 | Whitener | 175/317 X |
| 3,252,518 | 5/1966 | Tye, Jr. | 166/334 X |
| 3,768,562 | 10/1973 | Baker | 166/332 X |
| 4,103,739 | 8/1978 | Hall | 166/334 X |

*Primary Examiner*—Stephen J. Novosad

[57] ABSTRACT

A marine conductor string, wherein its lower part is provided with a connector. The connector comprises first and second coaxial tubular elements, a sleeve fixed to said first tubular element and axially displaceable relative to a second tubular element. The connector is furthermore provided with a fluid passage in the sleeve or in the second tubular element. Said fluid passage is so arranged that, by axial displacement of the sleeve relative to the second tubular element, a fluid communication between the interior of the conductor string and the water surrounding the conductor string can be created or eliminated. The invention relates as well to a connector suitable for use in the said conductor string.

10 Claims, 2 Drawing Figures

FIG. 1
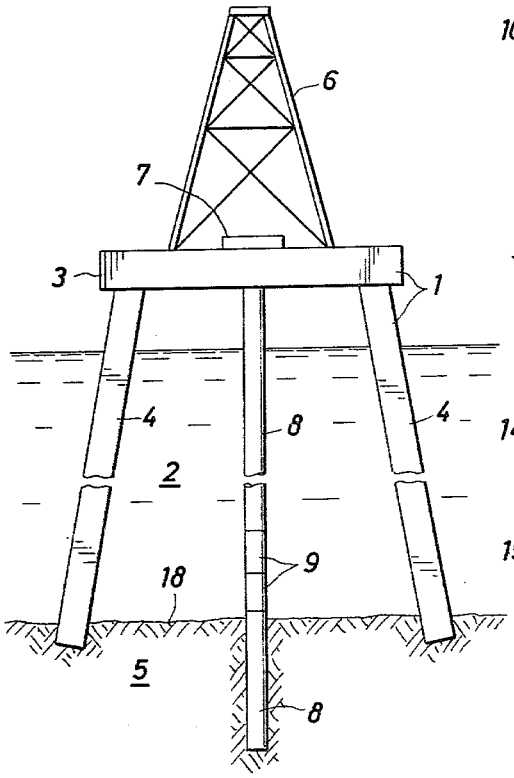
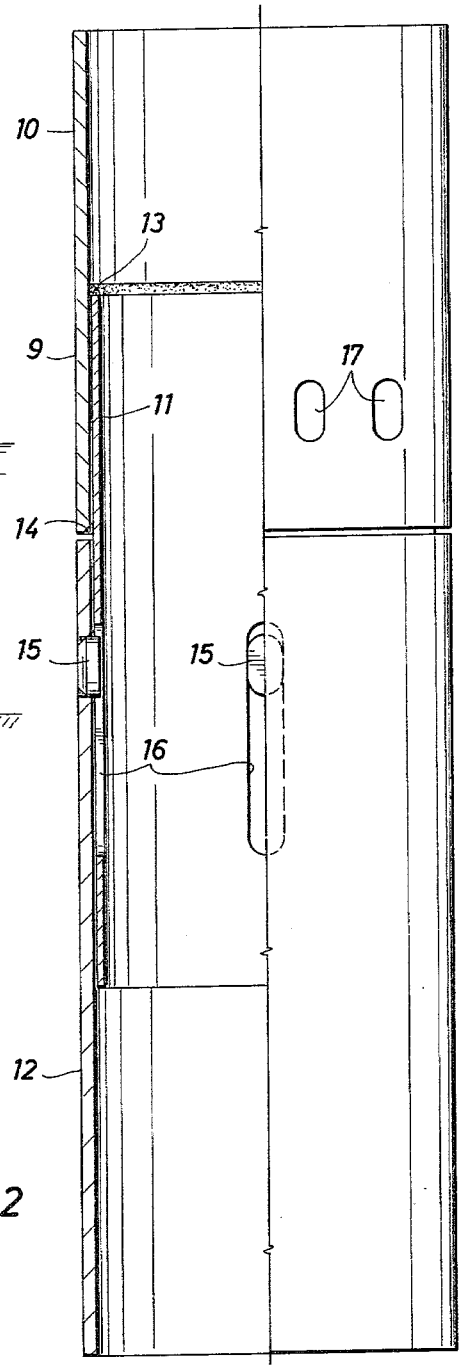
FIG. 2

MARINE CONDUCTOR STRING PROVIDED WITH A CONNECTOR AND A CONNECTOR FOR USE IN SUCH A MARINE CONDUCTOR STRING

BACKGROUND OF THE INVENTION

The invention relates to a conductor string extending from a marine platform into the bottom of a body of water.

When holes or wells are to be drilled in the seabottom by a drilling unit installed on a marine platform supported by the seabottom, the initial step in the drilling process includes the installation of a large diameter tube extending from a marine platform into the seabottom. This tube, hereinafter referred to as conductor string, consists of a plurality of pipe sections interconnected in end to end relationship and it may penetrate the seabottom to a certain depth. After the installation of the conductor string, a drill string carrying a drill bit at its lower end, is lowered through the conductor string for drilling a hole in the bottom. During the drilling operation, mud is supplied through the drill string to the bit for the purpose, amongst others, of removing cuttings from the hole which is being drilled. The mud leaving the bit is subsequently passed upwardly to the drilling unit through the annular space between the conductor string and the drill string. During the initial drilling period, the hydrostatic head of the mud column in the annular space is (in particular in deep water operations) considerably greater than the fracturing pressure of the formation layers of the seabottom in which the hole or well is being drilled. It will be appreciated that during the initial drilling period the hydrostatic head of the mud column should therefore be reduced to a value lower than the fracturing pressure of the formation, since fracturing of the formation may lead to loss of the hole being drilled or even to loss of the marine platform structure supporting the drilling unit. At a later stage of the drilling operation, when the hole has been drilled to a greater depth, at which depth the fracturing pressure is higher than the hydrostatic head of the mud column, a first casing is set and cemented in the hole, whereafter drilling is carried out in a normal manner.

SUMMARY OF THE INVENTION

It is an object of the invention to provide means for limiting the hydrostatic head of the mud column by reducing the length of the mud column in the conductor string during the initial stage of the drilling operation. Therefore, according to the invention the lower part of the conductor string is provided with a connector which comprises a first tubular element, a sleeve fixed to the first tubular element and axially displaceable relative to a second tubular element, cooperating guide means on the sleeve and the second tubular element, a fluid passage in the sleeve or in the second tubular element which fluid passage is so arranged that by axial displacement of the sleeve relative to the second tubular element a fluid communication between the interior and the exterior of the connector can be created or eliminated. When the sleeve and the second tubular element are in such a relative position that the said fluid communication is present, mud is allowed to escape from the interior of the conductor string to the water surrounding the conductor string. In this way the length of the mud column in the conductor string can be restricted to a length equal to the distance between the bottom of the hole and the said fluid passage.

In a suitable embodiment of the invention the cooperating guide means comprise radial guide blocks fitting in elongated holes. Preferably the elongated holes are so arranged in the sleeve or in the second tubular element that they are able to act as the said fluid passage.

The invention relates as well to a connector suitable for incorporation in the said conductor string.

BRIEF DESCRIPTION OF THE DRAWING

Hereinafter the invention will be described more in detail with reference to the drawings wherein:

FIG. 1 shows a schematic side view of a marine structure provided with a conductor string and a connector according to the invention.

FIG. 2 shows in detail and partially in section an embodiment of the connector according to the invention.

DESCRIPTION OF A PREFERRED EMBODIMENT

FIG. 1 of the drawings shows a marine structure, generally indicated by reference numeral 1, which comprises a platform 3 above the body of water 2 and legs 4, attached to the platform 3 and extending downwardly into the bottom 5 of the body of water 2. The marine platform 3 is provided with drilling equipment, generally indicated by reference numeral 6, which equipment includes a rotary table 7. A conductor string 8 extends from the platform 3 into the bottom 5 and is provided with a connector, generally indicated by reference numeral 9, which connector is located above and close to the surface 18 of the bottom 5. Referring now to FIG. 2, the connector 9 comprises a first tubular element 10, a sleeve 11, and a second tubular element 12. The sleeve 11 fits in the said tubular element 10 and is fixed thereto by means of welds 13 and 14. The sleeve 11 is moreover slidingly arranged within the second tubular element 12. Guide means are present, which comprise a plurality of radial guide blocks 15, secured to the second tubular element 12 which guide blocks extend into corresponding elongated holes 16 in the sleeve 11. The elongated holes 16 extend in an axial direction and are so arranged in the sleeve 11 that by displacing the second tubular element 12 over a predetermined distance relative to the sleeve 11, a fluid communication between the interior and the exterior of the connector 9 can be created or eliminated by the opening or closing of the elongated holes 16. Instead the sleeve 11 can be provided with separate openings (not shown) so arranged that they can act as a fluid passage between the interior and the exterior of the connector 9 in dependence on the relative position of the sleeve 11 and element 12. For obtaining a better connection between the sleeve 11 and the first tubular element 10, the wall of the first tubular element 10 is preferably provided with slots 17, through which the wall of the sleeve 11 is welded additionally to tubular element 10. As shown in FIG. 1 the connector 9 is incorporated in the lower part of the conductor string 8 by welding the first tubular element 10 and the second tubular element 12 respectively to a lower part and to an upper part of the conductor string 8.

The connector 9 is used as follows: The conductor string 8 provided with the connector 9, is lowered from the platform 3 and driven into the bottom 5 to a certain depth. In this position the connector 9 is located at some distance above the surface 18 of the bottom 5. Then a drill string (not shown) at the lower end provided with a drill bit (not shown) is lowered through the conductor string 8 for drilling a hole in the bottom 5. Through the drill string mud is pumped to the drill bit, which mud is recirculated through the annular space between the drill string and the conductor string 8.

During the initial stage of the drilling operation, the formation below the conductor string 8 can easily be fractured due to the lack of casing in the hole and the presence of a long mud column in the said annular space. Since such fracturing of the formation must be prevented, it is necessary to reduce the hydrostatic head of the mud column as by reducing the length of the mud column during the initial stage of the drilling operation. For this purpose, the part of the conductor string 8 which is located above the connector 9 is pulled upwardly over a predetermined distance, which causes at least partial uncovering of the elongated holes 16, so that a fluid communication is created between the interior and the exterior of the conductor string 8. This fluid communication enables the mud to flow through the holes 16 from the interior of the conductor string 8 into the water 2 surrounding the conductor string 8. In this way the length of the mud column is reduced to a length equal to the distance between the bottom of the hole and the elongated holes 16 in the sleeve 11. At a later stage of the drilling operation, when the drill bit has reached a greater depth, casing is inserted into the hole. After the casing has been inserted, the risk of fracturing of the formation is negligible. Therefore, at this stage of the drilling operation, the part of the conductor string 8 which is located above the connector 9 can be lowered again to its original position so that the elongated holes 16 in the sleeve 11 are covered again and the fluid communication between the interior of the conductor string 8 and the body of water 2 is eliminated. The drilling mud can be returned through the conductor string 8 to the platform 3 and the drilling operation can be carried out in a conventional manner.

In the embodiment as shown four elongated holes 16 are present. It will be appreciated that any suitable number of holes 16 can be used, for example three.

In the embodiment as shown the elongated holes 16 are located in the wall of the sleeve 11 and the said holes are covered or uncovered by axial displacement of the second tubular element 12. Instead, it is possible to arrange the said elongated holes in the second tubular element so that the said holes can be covered and uncovered by axial displacement of the sleeve relative to the second tubular element.

Furthermore it is possible, if desired, to arrange the said sleeve around the first and second tubular element instead of within these tubular elements.

The connector 9, which forms a slide valve in the conductor string 8, is preferably arranged above and close to the surface 18 of the bottom 5. Instead, it is possible to arrange the connector 9 at the surface 18 or even at a small distance below the surface 18. When the connector 9 is arranged below the surface 18, it should be at such a small distance below surface 18, and the top layers of the bottom material 5 should be so loose, that the mud passing through the fluid communication in the connector 9 will be able to flow from the connector 9 through the (loose) bottom material 5 to the water 2 surrounding the conductor string 8.

I claim as my invention:

1. A conductor string extending from a marine platform into the bottom of a body of water, wherein the lower part of the conductor string is provided with a connector which comprises a first tubular element, a second tubular element coaxially displaced from and adapted for end-to-end engagement with said first tubular element, a sleeve fixed to the first tubular element and arranged for limited axial displacement relative to said second tubular element in substantially surface-to-surface engagement, cooperating movement-limiting guide means on the sleeve and the second tubular element, a fluid passage in the sleeve which fluid passage is so arranged that by axial displacement of the sleeve relative to the second tubular element a fluid communication between the interior and the exterior of the connector can be created or eliminated.

2. The conductor string as claimed in claim 1, wherein the cooperating guide means comprise radial guide blocks fitting in elongated holes.

3. The conductor string as claimed in claim 2, wherein each radial guide block is secured to the second tubular element and extends into a corresponding elongated hole in the sleeve.

4. The conductor string as claimed in claim 3, wherein the elongated holes extend in an axial direction.

5. The conductor string as claimed in claim 2, wherein the elongated holes are so arranged in the sleeve that they are able to act as the said fluid passage.

6. The conductor string as claimed in claim 1, wherein the sleeve is slidingly arranged within the second tubular element.

7. The conductor string as claimed in claim 6, wherein the sleeve is fixed within the first tubular element.

8. The conductor string as claimed in claim 1, wherein the connector is located above and close to the surface of the bottom of the body of water.

9. A connector for use in a conductor string extending from a marine platform into the bottom of a body of water, which connector comprises a first tubular element, a second tubular element coaxially displaced from and adapted for end-to-end engagement with said first tubular element, a sleeve fixed to the first tubular element and arranged for limited axial displacement relative to said second tubular element in substantially surface-to-surface engagement, cooperating movement limiting guide means on the sleeve and the second tubular element, said cooperating guide means comprise radial guide blocks fitting in elongated holes, a fluid passage in the sleeve which fluid passage is so arranged that by axial displacement of the sleeve relative to the second tubular element a fluid communication between the interior and the exterior of the connector can be created or eliminated.

10. A connector as claimed in claim 9, wherein each radial guide block is secured to the second tubular element and extends into a corresponding elongated hole in the sleeve.

* * * * *